US006145677A

United States Patent [19]

Corniel

[11] Patent Number: 6,145,677

[45] Date of Patent: Nov. 14, 2000

[54] CLOTHES HANGING SYSTEM

[76] Inventor: Samuel R. Corniel, 2717 Adams St., Long Beach, Calif. 90810

[21] Appl. No.: 09/325,679

[22] Filed: Jun. 3, 1999

[51] Int. Cl.[7] ..... A47H 1/02

[52] U.S. Cl. ..... 211/105.1; 211/113; 248/251

[58] Field of Search ..... 248/215, 251, 248/258, 259; 211/105.1, 113, 123

[56] References Cited

U.S. PATENT DOCUMENTS

| | | | |
|---|---|---|---|
| 939,318 | 11/1909 | Redman . | |
| 3,260,489 | 7/1966 | Hentzi | 248/215 |
| 3,972,499 | 8/1976 | Simmons | 248/224 |
| 4,316,547 | 2/1982 | Varon | 211/105.1 |
| 5,107,996 | 4/1992 | Whittaker | 211/116 |
| 5,118,059 | 6/1992 | Mainer | 248/215 |
| 5,415,299 | 5/1995 | Usner | 211/105.1 |
| 5,487,517 | 1/1996 | Smith | 248/215 |
| 5,535,971 | 7/1996 | Adams | 248/215 |
| 5,702,010 | 12/1997 | Liang | 211/105.1 |

*Primary Examiner*—Ramon O. Ramirez
*Attorney, Agent, or Firm*—Joseph N. Breaux

[57] ABSTRACT

A clothes hanging system that is readily secured to an outdoor structure such as a fence to provide rods for supporting clothes away from the fence. The clothes hanging system includes a center hanger support structure and two identical hanger support rod supports.

1 Claim, 2 Drawing Sheets

CLOTHES HANGING SYSTEM

TECHNICAL FIELD

The present invention relates to clothes hanging system for supporting clothes when drying and the like and more particularly to a clothes hanging system that includes a center hanger support structure including a main F-shaped wall attachment bracket including a securing wing screw, and two pivoting telescoping hanger support rod assemblies each pivotally connected to a center support member permanently affixed to the end of the main F-shaped wall attachment bracket and including a telescopically extendable telescoping rod; and two identical hanger support rod supports each including a rod support F-shaped wall attachment bracket including a securing wing screw, the end of each rod support F-shaped wall attachment bracket having a tubular support rod end receiving tube attached to the end thereof sized to receive therein a rod end portion of the telescoping rod of one of the telescoping hanger support rod assemblies; each of the rod support F-shaped wall attachment brackets having a securing wing screw threaded through one of two spaced edge connecting structures depending downwardly from a horizontal structure thereof and a tubular support rod end receiving tube attached to an end of the horizontal structure.

BACKGROUND ART

It is often desirable to hang a number of clothing items in an outdoor location to dry to provide a freshening effect to the clothes as well to conserve energy. It would be desirable, therefore, to have a clothes hanging system that could be readily secured to an outdoor structure such as a fence which provided rods for supporting clothes away from the fence.

GENERAL SUMMARY DISCUSSION OF INVENTION

It is thus an object of the invention to provide a clothes hanging system that includes a center hanger support structure including a main F-shaped wall attachment bracket including a securing wing screw, and two pivoting telescoping hanger support rod assemblies each pivotally connected to a center support member permanently affixed to the end of the main F-shaped wall attachment bracket and including a telescopically extendable telescoping rod; and two identical hanger support rod supports each including a rod support F-shaped wall attachment bracket including a securing wing screw, the end of each rod support F-shaped wall attachment bracket having a tubular support rod end receiving tube attached to the end thereof sized to receive therein a rod end portion of the telescoping rod of one of the telescoping hanger support rod assemblies; each of the rod support F-shaped wall attachment brackets having a securing wing screw threaded through one of two spaced edge connecting structures depending downwardly from a horizontal structure thereof and a tubular support rod end receiving tube attached to an end of the horizontal structure.

Accordingly, a clothes hanging system is provided. The clothes hanging system includes a center hanger support structure including a main F-shaped wall attachment bracket including a securing wing screw, and two pivoting telescoping hanger support rod assemblies each pivotally connected to a center support member permanently affixed to the end of the main F-shaped wall attachment bracket and including a telescopically extendable telescoping rod; and two identical hanger support rod supports each including a rod support F-shaped wall attachment bracket including a securing wing screw, the end of each rod support F-shaped wall attachment bracket having a tubular support rod end receiving tube attached to the end thereof sized to receive therein a rod end portion of the telescoping rod of one of the telescoping hanger support rod assemblies; each of the rod support F-shaped wall attachment brackets having a securing wing screw threaded through one of two spaced edge connecting structures depending downwardly from a horizontal structure thereof and a tubular support rod end receiving tube attached to an end of the horizontal structure.

BRIEF DESCRIPTION OF DRAWINGS

For a further understanding of the nature and objects of the present invention, reference should be made to the following detailed description, taken in conjunction with the accompanying drawings, in which like elements are given the same or analogous reference number and wherein.

EXEMPLARY MODE FOR CARRYING OUT THE INVENTION

Figure 1:
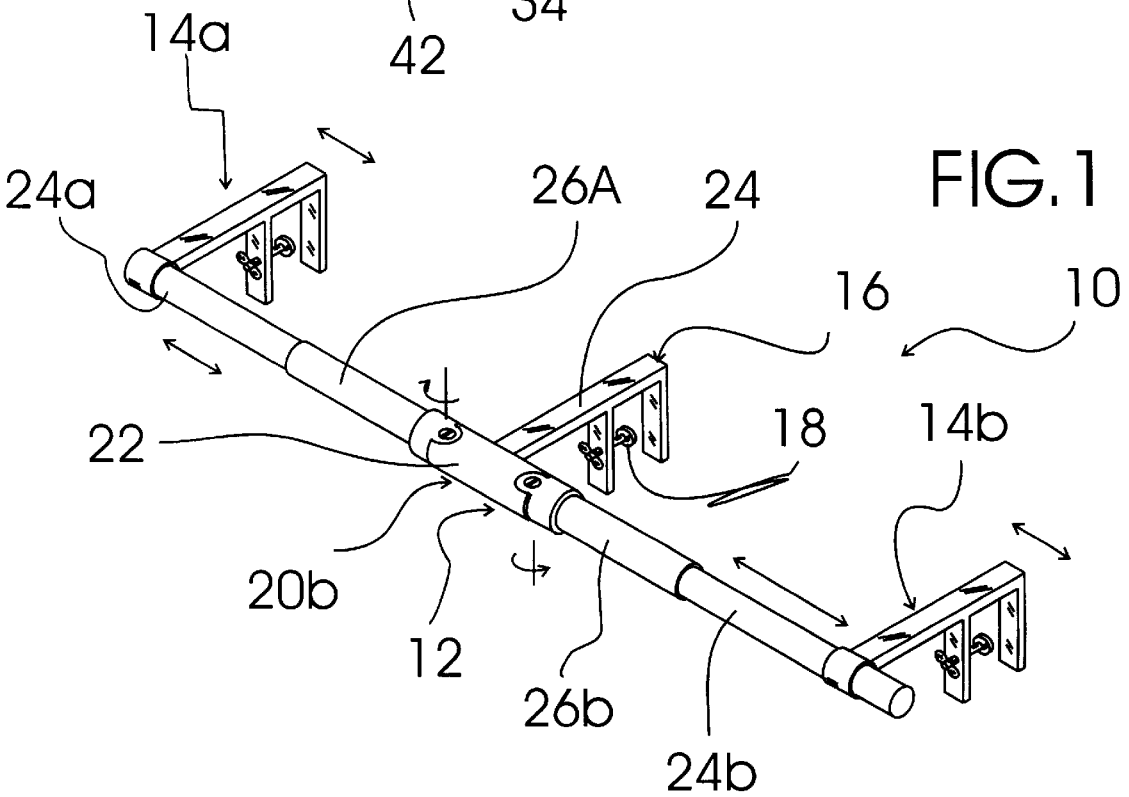
FIG. 1 is a perspective view of an exemplary embodiment of the clothes hanging system of the present invention showing the center hanger support structure including a main F-shaped wall attachment bracket including a securing wing screw, and two pivoting telescoping hanger support rod assemblies each pivotally connected to a center support member permanently affixed to the end of the main F-shaped wall attachment bracket and including a telescopically extendable telescoping rod; and the two identical hanger support rod supports each including a rod support F-shaped wall attachment bracket including a securing wing screw, the end of each rod support F-shaped wall attachment bracket having a tubular support rod end receiving tube attached to the end thereof sized to receive therein a rod end portion of the telescoping rod of one of the telescoping hanger support rod assemblies.
Figure 2:
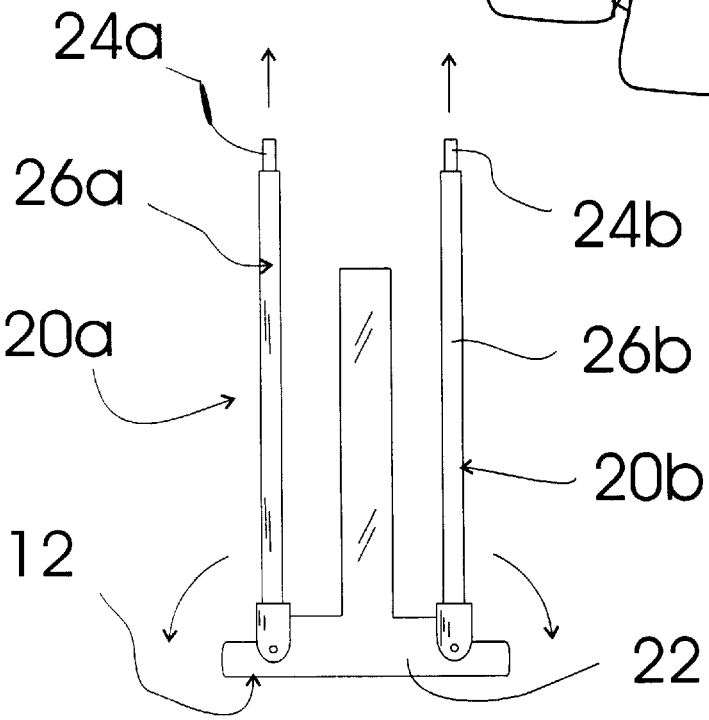
FIG. 2 is a top plan view of the center hanger support structure showing the two pivoting telescoping hanger support rod assemblies each with the telescoping rod completely retracted and pivoted perpendicularly with respect to the center support member.

FIG. 1 shows an exemplary embodiment of the clothes hanging system of the present invention generally designated 10. Clothes hanging system 10 includes a center hanger support structure, generally designated 12; and two identical hanger support rod supports, generally designated 14*a*,14*b*. Center hanger support structure 12 includes a main F-shaped wall attachment bracket, generally designated 16 and including a threaded securing wing screw 18; and two pivoting telescoping hanger support rod assemblies, each generally designated 20*a*,20*b*, each pivotally connected to a center support member 22 permanently affixed to the end 24 of main F-shaped wall attachment bracket 16. Each pivoting telescoping hanger support rod assembly 20*a*,20*b* includes a telescopically extendable telescoping rod 24*a*,24*b* that telescopes from a main tube portion 26*a*,26*b*. Referring to FIG. 2, each Each pivoting telescoping hanger support rod assembly 20*a*,20*b* pivots ninety degrees with respect to center member 22 from a collinear orientation (shown in FIG. 1) when in use to a perpendicular orientation (FIG. 2) for storage.

Figure 3:
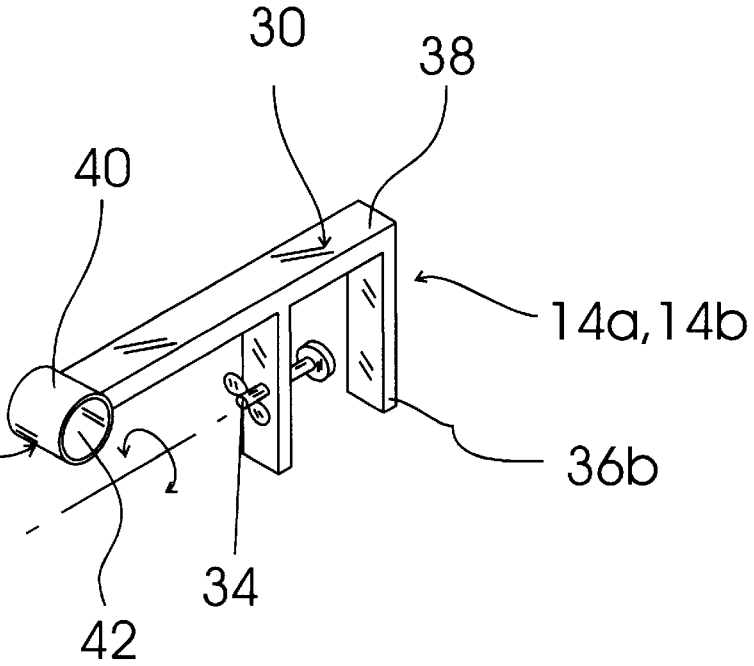
FIG. 3 is a perspective view of one of the two identical hanger support rod supports showing the rod support F-shaped wall attachment bracket with the securing wing screw threaded through one of the two spaced edge connecting structures depending downwardly from a horizon structure and the tubular support rod end receiving tube attached to the end of the horizontal structure of the rod support F-shaped wall attachment bracket.
Figure 4:
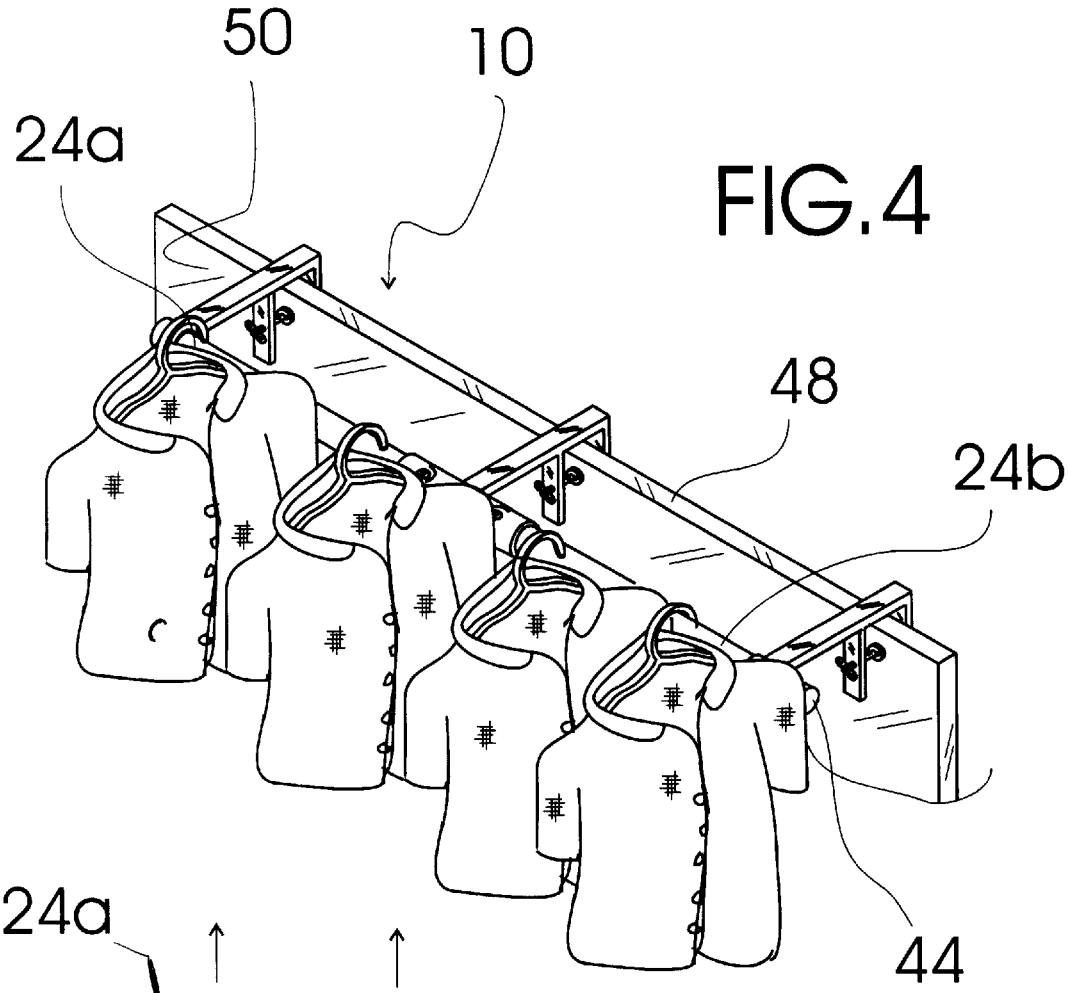
FIG. 4 is a perspective view of the exemplary clothes hanging system of FIG. 1 in use with the main F-shaped wall attachment bracket; the two rod support F-shaped wall attachment brackets secured to the top edge of a fence with the end portion of one of the telescoping rods positioned within each of the tubular support rod end receiving tubes; and clothes supported by the center hanger support structure.

Wit reference to FIG. 3, each of the two identical hanger support rod supports 14*a*,14*b* includes a rod support F-shaped wall attachment bracket, generally designated 30, and a tubular support rod end receiving tube, generally designated 32. Rod support F-shaped wall attachment bracket is constructed of steel and has a securing wing screw 34 threaded through one of the two spaced edge connecting structures 36*a*,36*b* depending downwardly from a horizontal structure 38. Tubular support rod end receiving tube 32 is attached to the end 40 of horizontal structure 38 and has a tubular passageway 42 sized to slidably receive therethrough, referring to FIG. 4, a rod end portion 44 of a telescoping rod 24*a*,24*b* during installation of clothes hanging system 10 onto the top edge 48 of a representative fence 50.

It can be seen from the preceding description that a clothes hanging system has been provided that includes a center hanger support structure including a main F-shaped wall attachment bracket including a securing wing screw, and two pivoting telescoping hanger support rod assemblies each pivotally connected to a center support member permanently affixed to the end of the main F-shaped wall attachment bracket and including a telescopically extendable telescoping rod; and two identical hanger support rod supports each including a rod support F-shaped wall attachment bracket including a securing wing screw, the end of each rod support F-shaped wall attachment bracket having a tubular support rod end receiving tube attached to the end thereof sized to receive therein a rod end portion of the telescoping rod of one of the telescoping hanger support rod assemblies; each of the rod support F-shaped wall attachment brackets having a securing wing screw threaded through one of two spaced edge connecting structures depending downwardly from a horizontal structure thereof and a tubular support rod end receiving tube attached to an end of the horizontal structure.

It is noted that the embodiment of the clothes hanging system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A clothes hanging system comprising:

a center hanger support structure including a main F-shaped wall attachment bracket including a securing wing screw, and two pivoting telescoping hanger support rod assemblies each pivotally connected to a center support member permanently affixed to an end of said main F-shaped wall attachment bracket and including a telescopically extendable telescoping rod; and two identical hanger support rod supports each including a rod support F-shaped wall attachment bracket including a securing wing screw, an end of each rod support F-shaped wall attachment bracket having a tubular support rod end receiving tube attached to said end thereof sized to receive therein a rod end portion of said telescoping rod of one of said telescoping hanger support rod assemblies;

each of said rod support F-shaped wall attachment brackets having a securing wing screw threaded through one of two spaced edge connecting structures depending downwardly from a horizontal structure thereof and a tubular support rod end receiving tube attached to an end of said horizontal structure.

* * * * *